US006298583B1

(12) United States Patent
Allen

(10) Patent No.: US 6,298,583 B1
(45) Date of Patent: Oct. 9, 2001

(54) CAMP SHOE

(76) Inventor: Daniel M. Allen, 6148 Middleboro Rd., Blanchester, OH (US) 45107

( * ) Notice: Subject to any disclaimer, the term of this patent is extended or adjusted under 35 U.S.C. 154(b) by 0 days.

(21) Appl. No.: 09/525,674

(22) Filed: Mar. 15, 2000

(51) Int. Cl.[7] ..... A43B 3/24

(52) U.S. Cl. ..... 36/100; 36/102; 36/105; 36/47; 36/113

(58) Field of Search ..... 36/100, 102, 113, 36/47, 105

(56) References Cited

U.S. PATENT DOCUMENTS 3,192,651 * 7/1965 Smith .
4,783,909 * 11/1988 Van Doren et al. .
5,127,170 * 7/1992 Messina .

* cited by examiner

*Primary Examiner*—Ted Kavanaugh
(74) *Attorney, Agent, or Firm*—Neal O. Willmann

(57) ABSTRACT

This disclosure relates to a camp shoe that is similar in most aspects to a typical shoe. However, to make it easy to pack and tote in a knapsack, for example, this shoe has construction features that permit it to be folded flat to conform with sole of the shoe and, therefore, be easily tucked in and toted in luggage where spare space is typically at a premium. The construction features include a rigid heel counter; a heel support flexibly attached to said heel counter; a pair of upper ankle supports flexibly attached to said heel support; and a pair of lower ankle supports flexibly attached to said upper ankle supports and said heel counter.

5 Claims, 3 Drawing Sheets

FIG. 5
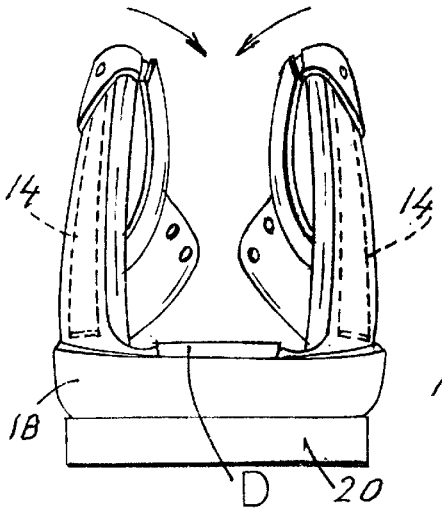
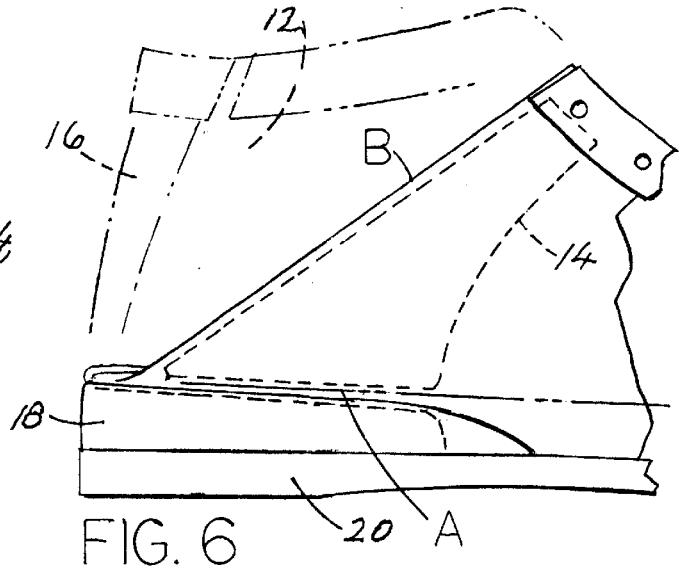
FIG. 6
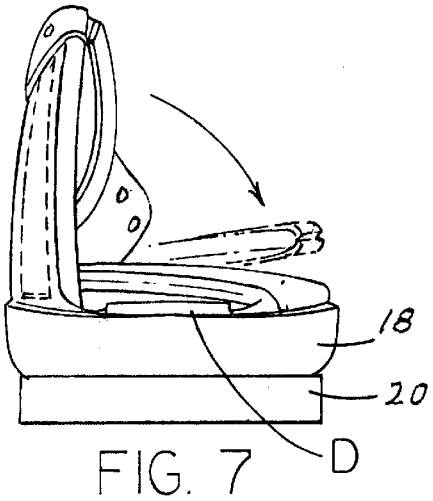
FIG. 7
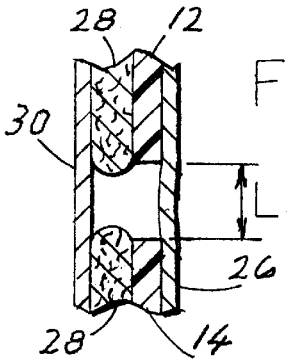
FIG. 8
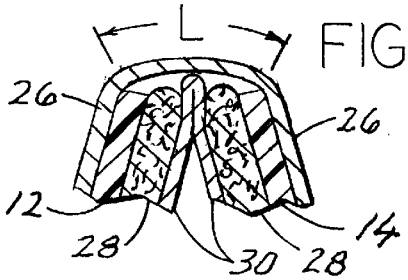
FIG. 9
FIG. 10
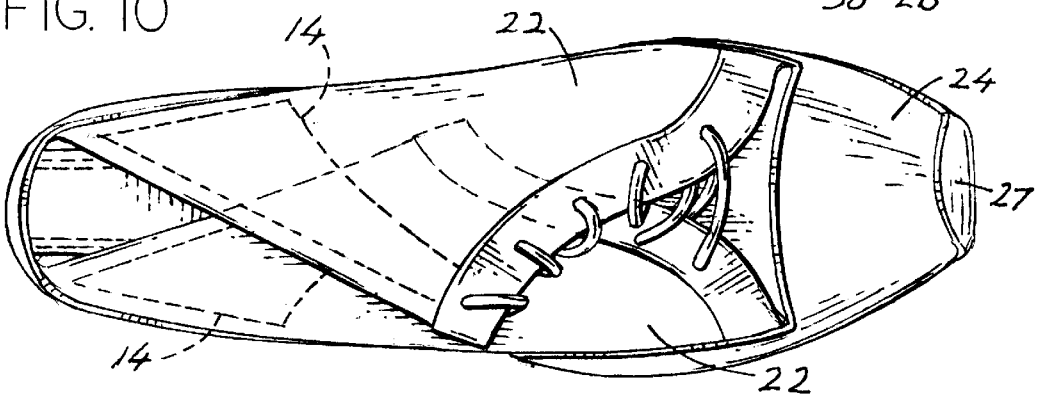

CAMP SHOE

BACKGROUND OF THE INVENTION

This disclosure relates generally to footwear, and more particularly to footwear for outdoor use. Specifically, this disclosure relates to a genre of shoes called "camp shoes." Camp shoes are worn by backpackers once a suitable camp site is reached or established.

The extra pack-weight and irregular terrain of the outdoors require the use of relatively rigid and confining boots to help support the backpacker's foot and ankle during the daily hike. Backpack weight, rough terrain and the duration of the hike can contribute to foot discomfort. Thus, it is desirable to relieve the foot of the confines of a hiking boot as soon as practical after the hike has been completed and camp established.

Camp shoes should be collapsible and light-weight in order to minimize the size and weight of the backpack. Camp shoes should also provide adequate support and protection to help avoid foot injuries resulting from in-camp activities such as carrying water, gathering fire-wood, and taking short hikes to the latrine. It is also conceivable that camp shoes might be pressed into service to serve as emergency hiking boots in the event that the primary boots are lost or damaged or become otherwise un-wearable.

Sandals, tennis shoes, running shoes, house slippers and moccasins have all been used by backpackers as camp shoes. Taken alone, none of these types of footwear has features that provide the degree of packability, foot protection and support desirable in the optimum camp shoe.

It is one of the objectives of this disclosure to provide shoe features that allow a shoe upper to be both collapsible and supportive of the wearer's foot and ankle. Such features, when introduced into a light-weight shoe constructed for outdoor use, result in a superior shoe design for camp use by backpackers.

DESCRIPTION OF THE PRIOR ART

An example of a shoe that does not address the question of packability but appears to be somewhat foldable, nonetheless, is disclosed in U.S. Pat. No. 4,783,90 which issued Nov. 15, 1988, to Van Doren et al. While the description of the shoe in that document does not employ standard shoe construction nomenclature, it is apparent that the shoe of that disclosure utilizes butt joints that function as hinges to permit portions of what are called "quarters" to fold downward in conjunction with what is called a "heel counter" so that what appears to be a regular shoe can be converted into a slipper.

While a shoe that can convert quickly into a slipper might be useful in some packing and camping venues, it does not have the construction features that are established and defined for the camp shoe described herein. The disclosed shoe is remarkable for its light weight, durability and support features as well as for its foldability and packing attributes. More specifically, the shoe according to the disclosed invention can be described as follows:

SUMMARY OF THE INVENTION

Disclosed herein is a camp shoe that resembles a typical shoe with a heel and sole, a toe and upper with construction features that permit easy folding and packing in, for instance, a backpack. The unique construction features of the disclosed shoe comprise: a rigid heel counter to discourage lateral movement of a foot in said shoe; a heel support flexibly attached to said heel counter; a pair of lower ankle supports flexibly attached to said heel counter; and a pair of upper ankle supports flexibly attached to said heel support and said lower ankle supports. As a result of these construction features, the heel support, the lower ankle supports and the upper ankle supports can each be folded to lie upon and conform with the heel and sole to facilitate packing. More economical versions of the disclosed camp shoe can be constructed without the heel counter and heel support, and the shoe will fold and permit packing according to the disclosed invention, but the substance of the shoe and support offered to the wearer will be diminished.

BRIEF DESCRIPTION OF THE DRAWING

FIG. 5 is an elevational view of the shoe as shown in FIG. 3 with the heel support and upper ankle supports folded down and inward. The toe and tongue are not shown for clarity.

FIG. 6 is an elevational side view of FIG. 5 with the heel support and upper ankle supports, shown in the pre-folded orientation, in phantom.

FIG. 7 is an elevational heel view of the shoe as shown in FIG. 5, but with the right quarter folded at fold line A. The eventual orientation of the left quarter is shown in phantom.

FIG. 8 is a cross-sectional view of fold line B taken along line 8—8 of FIG. 1.

FIG. 9 is the cross-sectional view of FIG. 8 folded along fold line B.

FIG. 10 is top plan view of the shoe as depicted in FIG. 2.

DESCRIPTION OF THE PREFERRED EMBODIMENTS

Figure 1:
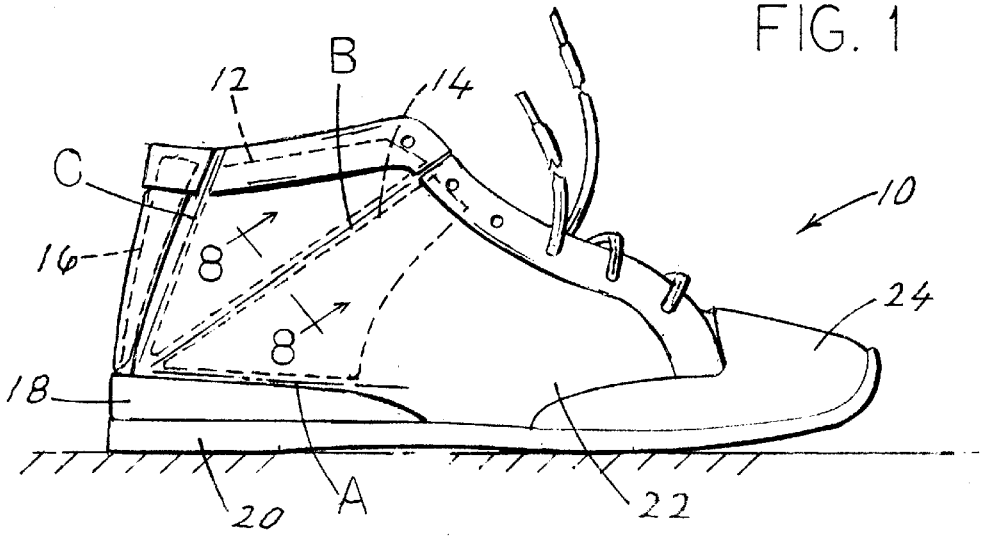
FIG. 1 is an elevated side view of the disclosed shoe. In this view, both sides are almost identical.

The foldable and packable camp shoe 10 disclosed herein can be seen in FIG. 1 wherein the shoe is depicted in a wearable mode. More specifically, the elevated side view of FIG. 1 presents the shoe 10 with its unique and its traditional elements. Typically, the camp shoe 10 has a sole 20 fashioned from a semi-rigid material which is both rigid enough to provide support and protection to the sole of the foot and flexible enough to be comfortable. Generally, the sole will be made of a molded rubber material although any of a variety of composite materials can and will be used when merited by the dictates of cost, comfort and function.

Figure 2:
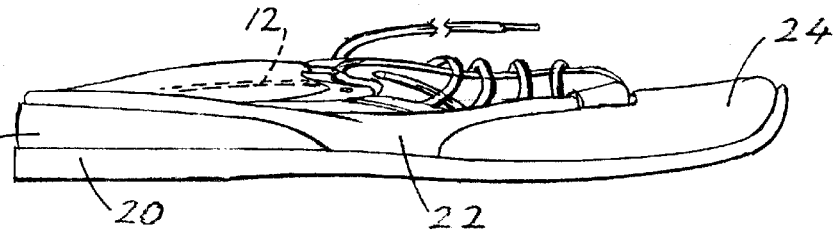
FIG. 2 is an elevated side view of the shoe in FIG. 1 in a folded or compressed form. In this form the shoe has a low profile that facilitates packing.

FIG. 1 also shows the toe 24 for covering the fore or toe portion of the foot and the quarter 22 which comprises the sides of the shoe between the toe 24 and the heel 16. In the preferred embodiments of the instantly disclosed camp shoe, the ankle support areas include the upper ankle support 12 and the lower ankle support 14. The upper and lower support areas are separated by a fold line B which is designed to permit the upper ankle support 12 to articulate in planes different from the lower ankle support. Articulation of the upper ankle support 12 will also permit the upper and lower supports to lie in a parallel orientation when the shoe is folded preparatory to packing. FIG. 2 depicts an elevated side view of the camp shoe 10 in a fully folded posture.

To facilitate folding the ankle supports 12 and 14 into a packing orientation, it is necessary for the lower ankle support, and indeed the entire quarter 22, to articulate along fold line A. Fold line A is positioned between the lower ankle support and the heel counter 18, as shown in FIG. 1. The heel counter is preferably fabricated from a semi-rigid material to discourage lateral movement of the heel of the foot relative to the heel of the shoe.

Figure 3:
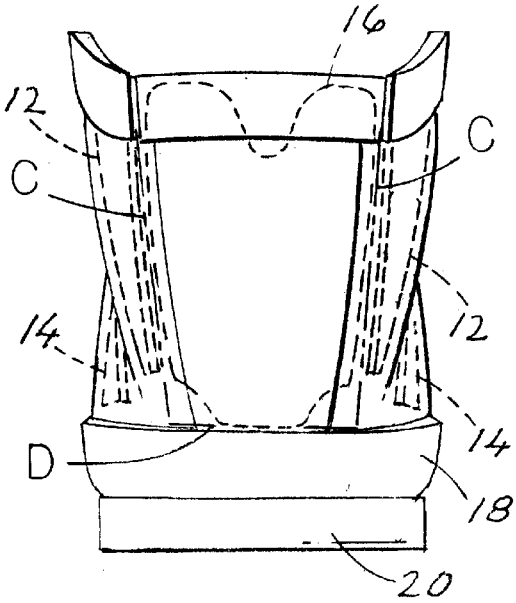
FIG. 3 is a rear elevational view of the rear or heel of the shoe.

In FIG. 3, an elevated rear view of the camp shoe 10, a heel support 16 is shown. The heel support 16 spans the right and left upper ankle supports 12 and articulates along two fold lines: fold line D and right and left fold-lines C. Fold line D is positioned between the heel counter 18 and the heel support 16. Fold line D permits the articulation of the heel support 16 allowing it to fold forward to the sole 20 of the camp shoe 10 when the shoe is prepared for packing. Fold lines C, positioned between the heel support 16 and the upper ankle supports 12, permit full articulation between the heel support and the right and left upper ankle supports 12 when the heel support is pushed forward. FIG. 5 is a representation of the disclosed shoe with the heel support 16 and the upper ankle supports 12, each articulated fully along fold lines B, C and D. For added clarity, FIG. 6 provides an elevated side view of FIG. 5 with the heel support 16 and the upper ankle supports 12 shown in phantom in their pre-folded position.

Figure 4:
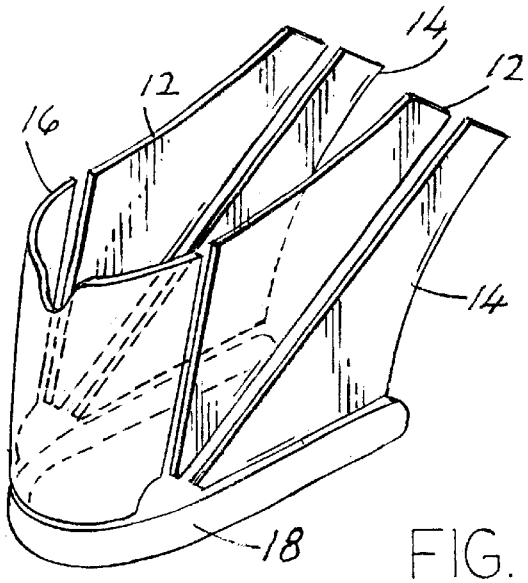
FIG. 4 is a perspective view of the exposed heel counter, heel support, and upper and lower ankle supports.
Figure 11:
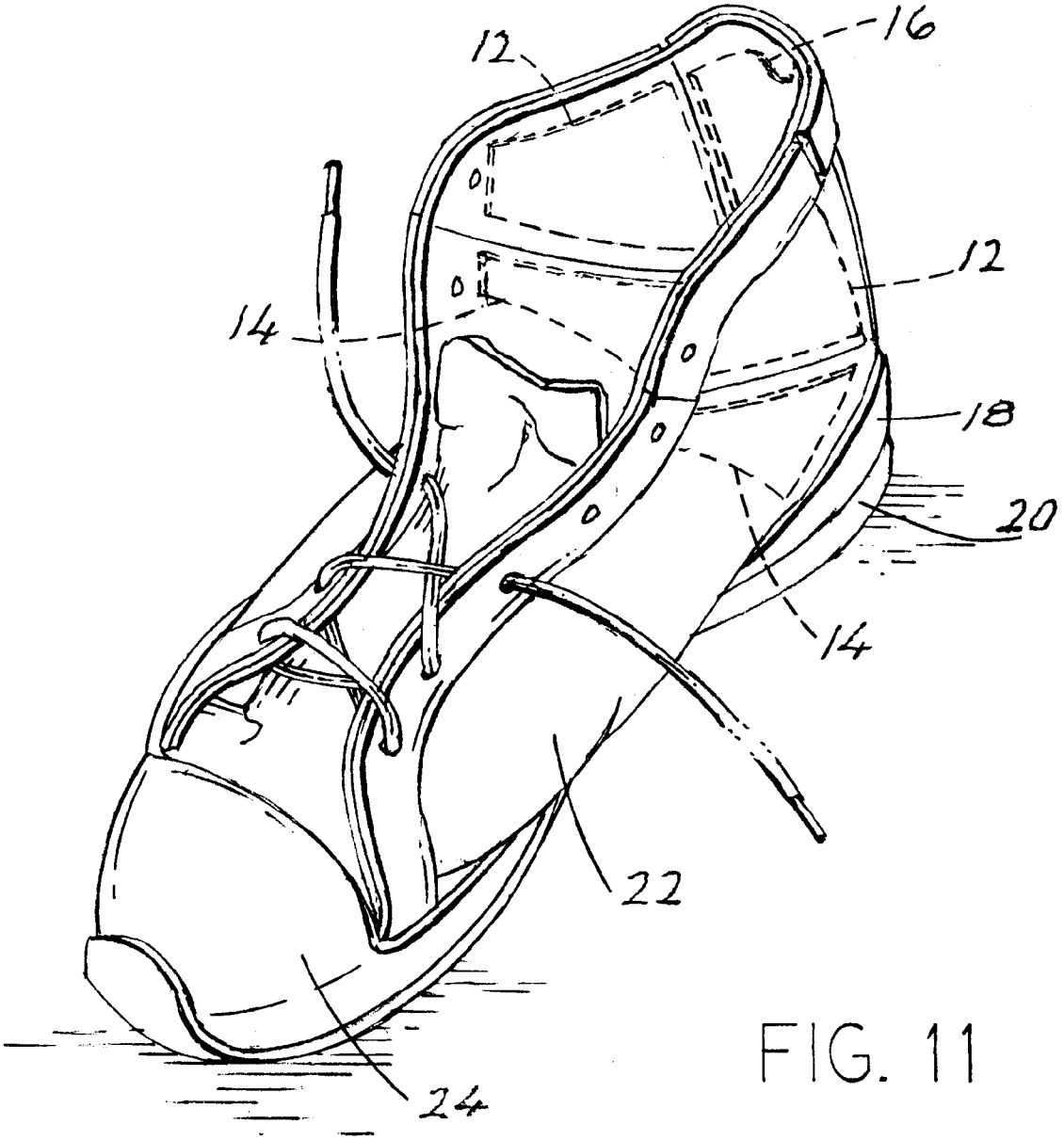
FIG. 11 is an elevated perspective view of the camp shoe.

In FIG. 4, the relative position of the heel support and ankle supports is shown without a liner or outer covering when the shoe is in a wearable, unfolded mode. Clearly shown are heel counter 18, paired lower ankle supports 14, paired upper ankle supports 12, and heel support 16. Typically the supports will be fabricated from a semi-rigid material that will provide "body" to the heel and ankle areas of the shoe 10, and therefore provide support to the foot of the wearer. Ideally, these supports will be fashioned from a thin plastic material and will be stitched to the shoe upper between an inside liner and an outer covering of the shoe. Canvas or nylon fabrics are the materials of choice for the outer covering of the quarter 22 and tongue, not shown.

Leather, rubber or rubberized plastic, are the materials of choice for the high wear areas of the toe 24 and a cover over the heel counter 18. A preferred method of manufacture is to use a molded heel and sole with integral sides that extend approximately ⅝ inch up the sides of the shoe above the sole 20. This allows the low heel counter 18 and any cover of the counter to be replaced by the sides of a unitary, ascending sole. Furthermore, such construction could allow the sides of the toe 24 to extend aft from the toe area and be replaced by a molded sole. The molded unitary sole could also have a toe cap 27 to provide protection to the toe area of the shoe and thus allow the toe 24 to be eliminated . Such a combination and configuration are expected to greatly reduce the manufacturing cost of the shoe 10.

FIG. 7 is a continuation of FIG. 5. It shows the fully articulated heel support, the upper ankle supports 12, as shown in FIG. 5, but with the right lower ankle support 14 and quarter 22 fully articulated along fold line A. The left quarter 22 comprising the folded upper ankle support 12 is shown prior to folding. The arrow shows the direction for folding the left side. The phantom view shows the approximate final positions of the folded camp shoe when the left quarter 22 is folded along its fold line A.

To provide a better understanding of the fold lines, reference should be made to FIGS. 8 and 9. FIG. 8 is a cross-sectional view of fold line B taken along line 8—8 of FIG. 1. From this perspective, the continuous outer shell or "outer" 26 and the continuous inside covering or "liner" 30 of the shoe 10 are apparent. Also evident are the upper 12 and lower 14 ankle supports and the padding or insulation material 28. All, except the liner and outer cover, are discontinuous at the fold line to permit approximately 180° of articulation of upper and lower ankle supports. The ultimate articulation is shown in FIG. 9 where the upper and lower ankle supports are depicted in near parallel alignment.

Note that length (L) is the necessary stretched outer material 26 distance between upper ankle support 12 and lower ankle support 14 across fold line B. This length is roughly equal to twice the combined thickness of compressed padding or insulation 28, the upper and lower ankle supports 12 and 14 and the liner 30, as can be seen from FIG. 9. Along fold line D between heel support 16 and heel counter 18, and right and left fold line A between the heel counter 18 and lower ankle support 14, a similar material distance (L) can be reduced because articulation along fold lines D and A does not exceed approximately 90°. For this reason, a preferred embodiment could be the use of a stretchable cotton or nylon fabric to serve as the outer material or covering along fold lines A and B thereby eliminating the gap (L) between supports shown in FIG. 8, but not the discontinuity. The relatively stiff, non-foldable supports and insulation would ideally be discontinuous across the fold lines to reduce resistance to articulation. However, a thin membrane of support material could link the supports to permit unitary construction and allow for articulation along the fold lines as well.

The right and left fold lines C, between heel support 16 and upper ankle supports 12, is another 180° fold, once the shoe is completely readied for packing as shown in FIGS. 2 and 10. This fold, however, is in a direction opposite to that of fold lines A, B and D. As a result, the required material distance for full articulation applies now to liner 30 instead of outer layer 26. Certainly, a preferred embodiment uses a stretchy liner material across this fold to prevent bunching of the liner material when the shoe is in a wearable mode.

A summary of the steps taken to prepare a pair of camp shoes 10 for packing follows: Referring to FIGS. 1, 5 and 6, heel support 16 is first articulated along fold line D toward the toe of the shoe until it lies just past parallel to the inside surface of sole 20. This articulation also forces an articulation along fold lines C and B so that upper ankle support 12 is folded to the inside of lower ankle support 14 until the two supports lie parallel to one another. In this position, fold line D has been articulated approximately 90°, fold line C has been articulated approximately 90°, and fold line B has been articulated approximately 180°. Furthermore, fold lines A and C are now roughly parallel and in proximity. Heel support 16 and upper ankle support 12 now lie in the interior of the shoe, and the shoe is folded to the extent shown in FIGS. 5 and 6. From this level of articulation, folding for packing continues by articulating first one side of the shoe along fold line A approximately 90°, and then the other side. This also forces further articulation of fold line C. FIG. 7 shows an example where the right side of the shoe has been folded first and the left side is ready to be folded as indicated by the arrow to the position shown in phantom. With both sides of the shoe folded, it is now prepared for packing as shown in FIGS. 2 and 10. Note that FIGS. 2 and 7 show the sides of the shoe in a position just less than 90° along fold line A for clarity. In the preferred embodiment, the height of heel counter 18 allows the entire heel and ankle area of the shoe to be packed into a volume bounded by the interior sole surface, and the heel counter. Once both shoes are folded as shown in FIGS. 2 and 10, they can be placed together, sole bottom to sole bottom, and packed. A preferred embodiment provides a sack to further compress and store the folded shoes.

It should be noted that shoe 10 can be worn as a slipper when folded to the extent shown in FIGS. 5 and 6. The folded upper and lower ankle supports provide an added element of stiffness to the unfolded part of quarter 22, and the shoe naturally maintains its shape for easy insertion of the foot. Wearing the shoe in this mode is much like wearing an existing type of shoe known as a clog.

An alternative embodiment exists for placement of the entire support structure, made up of heel counter 18, heel support 16, upper and lower ankle supports 12 and 14 on the exterior surface of the shoe. This embodiment may be useful to reduce shoe assembly costs but may not be as visually appealing.

While the foregoing is a complete and detailed description of preferred embodiments of the disclosed camp shoe, numerous variations and modifications may be employed to implement the all-important purpose of the shoe without departing from the spirit of this invention; and, therefore, the elaboration provided should not be assumed to limit, in any way, the scope of the invention, which is fairly defined by the appended claims.

What I claim is:

1. A camp shoe that resembles a typical shoe with a heel and sole, a toe and upper with construction features that permit easy folding and packing in, for instance, a backpack, said construction features comprising: a rigid heel counter to discourage lateral movement of a foot in said shoe; a heel support flexibly attached to said heel counter; a pair of lower ankle supports flexibly attached to said heel counter; and, a pair of upper ankle supports flexibly attached to said heel support and said lower ankle supports, whereby said heel support, said lower ankle supports and said upper ankle supports can each be folded to lie upon and conform with the heel and sole to facilitate packing.

2. A camp shoe according to claim 1 wherein said heel and sole are of a rigid, unitary construction.

3. A camp shoe according to claim 1 wherein said rigid heel counter is a continuation of said heel and sole.

4. A camp shoe according to claim 1 wherein the upper comprises a liner and an outer layer.

5. A camp shoe according to claim 4 wherein the upper and lower ankle supports and the heel support are sewn between the outer layer and inside liner of the shoe.

* * * * *